US009113709B2

(12) United States Patent
Jewett

(10) Patent No.: US 9,113,709 B2
(45) Date of Patent: Aug. 25, 2015

(54) ARTIST'S EASEL AND METHOD

(76) Inventor: Mark S. Jewett, Media, PA (US)

( * ) Notice: Subject to any disclaimer, the term of this patent is extended or adjusted under 35 U.S.C. 154(b) by 424 days.

(21) Appl. No.: 13/437,256

(22) Filed: Apr. 2, 2012

(65) Prior Publication Data

US 2013/0256495 A1 Oct. 3, 2013

(51) Int. Cl.
*A47B 97/04* (2006.01)

(52) U.S. Cl.
CPC ..... *A47B 97/04* (2013.01)

(58) Field of Classification Search
CPC ..... A47B 97/04; A47B 97/06; A47B 97/08; A47F 7/00; A47F 5/00; A47F 5/12; F16M 11/00; F16M 13/00; B60B 11/10; A47G 1/143; B43L 5/002; B43L 1/00; B43L 5/00
USPC ..... 248/460, 463, 464, 465, 441.1, 447.1, 248/163.1, 169, 439, 440, 440.1, 451, 447, 248/444, 453, 188.1, 188.8, 188.7, 188.5, 248/165, 172, 171, 170, 168, 188, 449, 448, 248/459, 456
See application file for complete search history.

(56) References Cited

U.S. PATENT DOCUMENTS

| | | | | | |
|---|---|---|---|---|---|
| 213,263 | A | * | 3/1879 | Vizet | 248/441.1 |
| 243,407 | A | * | 6/1881 | Shedlock | 248/465 |
| 289,799 | A | * | 12/1883 | Barnes | 248/459 |
| 384,171 | A | * | 6/1888 | Morris | 248/463 |
| 410,191 | A | * | 9/1889 | Pluche | 248/449 |
| 505,306 | A | * | 9/1893 | Bohlinger | 248/460 |
| 516,425 | A | | 3/1894 | Beecher | |
| 611,434 | A | * | 9/1898 | Lane | 248/463 |
| 654,841 | A | | 7/1900 | Sabin-Macdonald | |
| 1,840,595 | A | * | 1/1932 | Moore | 222/132 |
| 2,142,317 | A | * | 1/1939 | Jarrett | 248/449 |
| 2,353,625 | A | * | 7/1944 | Moore | 40/603 |
| 2,511,537 | A | | 6/1950 | Migdow | |
| 2,611,427 | A | * | 9/1952 | Du Mais et al. | 160/329 |
| 2,638,300 | A | * | 5/1953 | De Jen | 248/464 |
| 2,700,587 | A | | 1/1955 | Godfrey | |
| 3,153,525 | A | * | 10/1964 | Guth | 248/188.6 |
| 3,203,555 | A | | 8/1965 | Garcia | |
| 3,286,847 | A | | 11/1966 | Leblanc | |
| 3,740,012 | A | | 6/1973 | Millen | |
| 4,093,326 | A | | 6/1978 | Ford | |
| 4,181,282 | A | * | 1/1980 | Oliver et al. | 248/448 |
| 4,260,124 | A | * | 4/1981 | Heilman | 248/449 |
| 4,627,592 | A | * | 12/1986 | Stillwell | 248/465 |
| 4,629,150 | A | * | 12/1986 | O'Callaghan | 248/167 |
| D305,669 | S | | 1/1990 | Deusinger | |
| 4,971,284 | A | * | 11/1990 | Curry | 248/460 |
| 4,979,717 | A | * | 12/1990 | Okayasu | 248/449 |
| 5,125,613 | A | * | 6/1992 | Albee et al. | 248/464 |
| 5,662,303 | A | | 9/1997 | Rellinger | |
| 5,746,406 | A | * | 5/1998 | Dicke et al. | 248/166 |
| 5,752,679 | A | * | 5/1998 | Thomason | 248/49 |

(Continued)

*Primary Examiner* — Nkeisha Smith
(74) *Attorney, Agent, or Firm* — Robert J. Yarbrough of Lipton, Weinberger & Husick

(57) ABSTRACT

The invention is a tripod easel in which the first, second and third legs are elastically deformable in the forward and rearward directions between a first position and a second position. In the second position, the first and third legs define arcs in the forward direction and the second leg defines an arc in the rearward direction. In the second position, the three legs define a free-standing tripod. The first and third legs define rows of supporting holes that can support an artwork support apparatus, a cantilevered shelf, a palette holder, a paper towel holder or other accessories.

17 Claims, 10 Drawing Sheets

(56) References Cited

U.S. PATENT DOCUMENTS

| | | | | |
|---|---|---|---|---|
| 5,899,429 | A | 5/1999 | McCloud | |
| 5,950,979 | A * | 9/1999 | Mira | 248/460 |
| 6,206,183 | B1 * | 3/2001 | Helsel | 206/1.7 |
| 6,234,442 | B1 * | 5/2001 | Huang | 248/464 |
| 6,240,857 | B1 * | 6/2001 | Elizer | 108/152 |
| 6,648,293 | B1 * | 11/2003 | Sachnoff | 248/460 |
| 6,745,988 | B2 | 6/2004 | Gelfand | |
| 6,772,987 | B2 | 8/2004 | Jones | |
| 7,188,818 | B2 | 3/2007 | Chang | |
| 7,740,219 | B2 * | 6/2010 | Stengel et al. | 248/464 |
| 7,823,857 | B2 * | 11/2010 | Stengel et al. | 248/450 |
| 8,522,965 | B1 * | 9/2013 | Hsiung | 206/45.24 |
| 8,763,539 | B2 * | 7/2014 | Odar Pena et al. | 108/157.18 |

* cited by examiner

FIG. 2
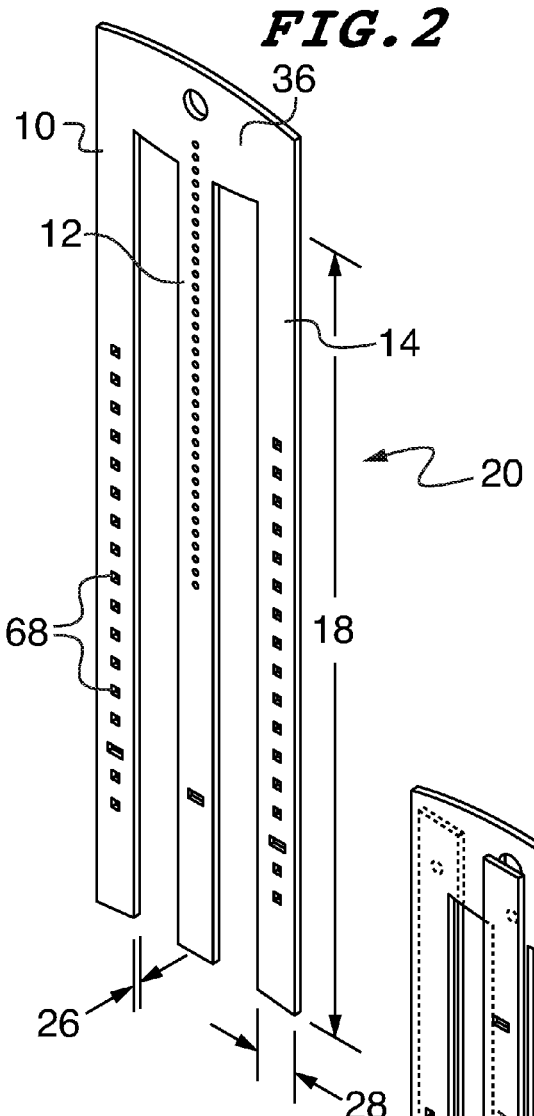
FIG. 3
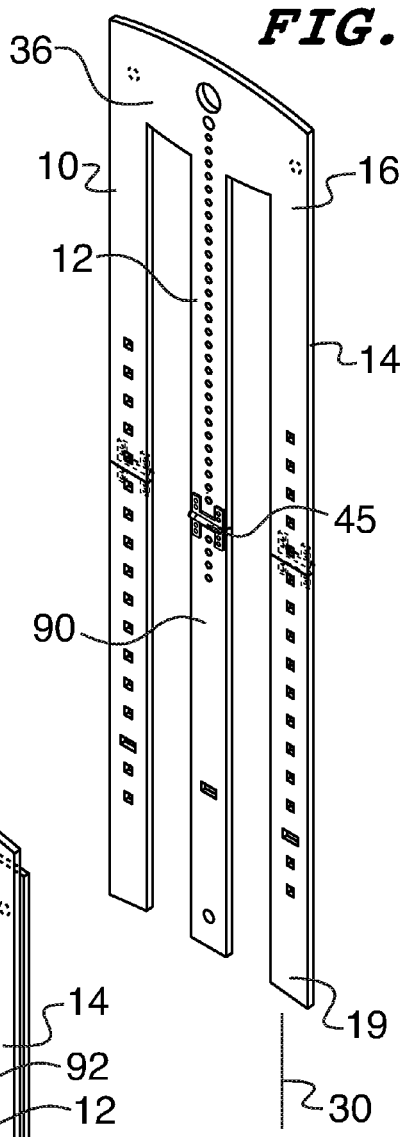
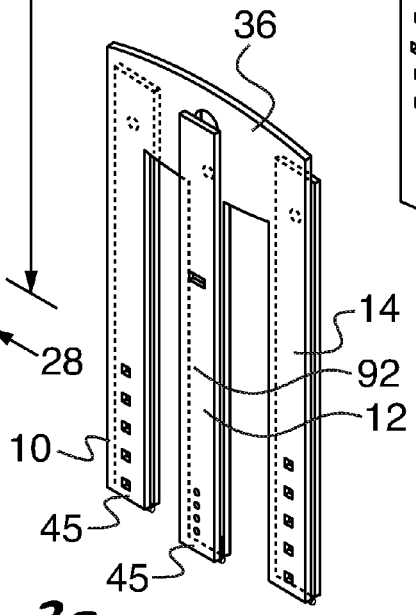
FIG. 3a

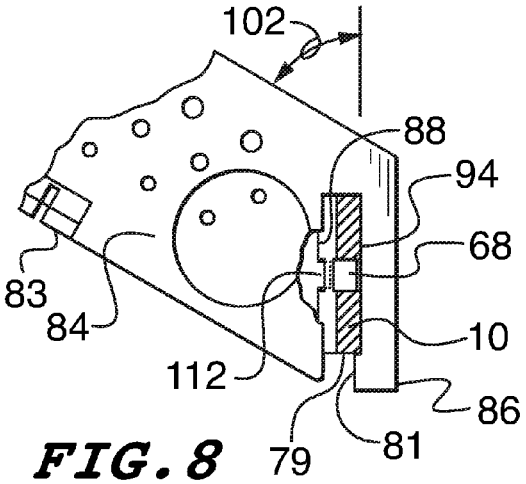
FIG. 8
FIG. 9
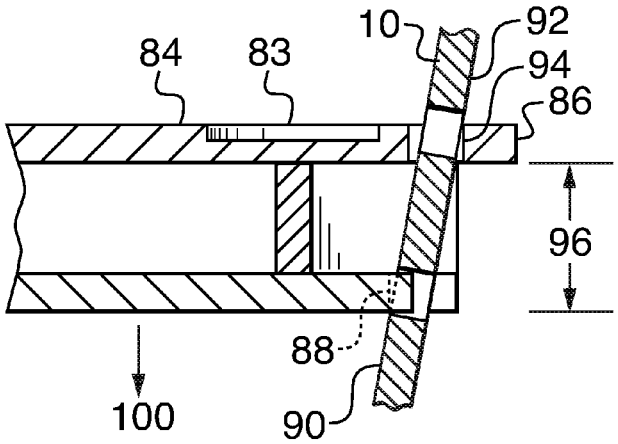
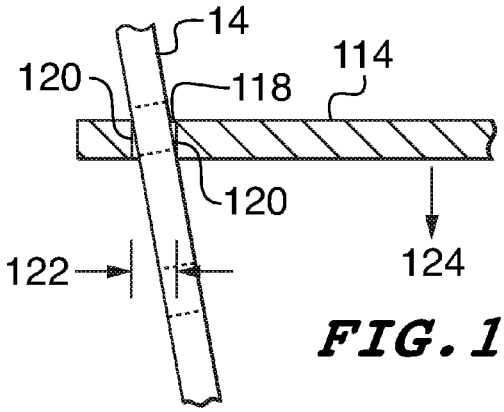
FIG. 10

FIG. 11
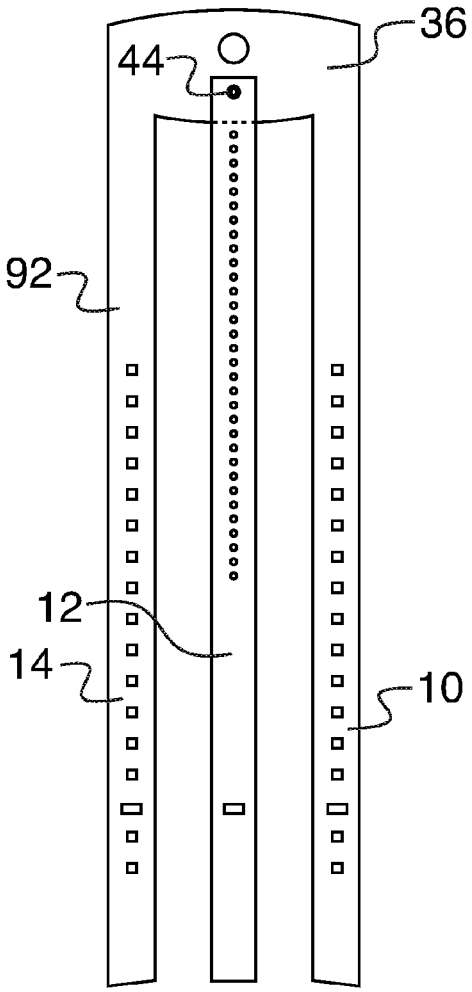
FIG. 13
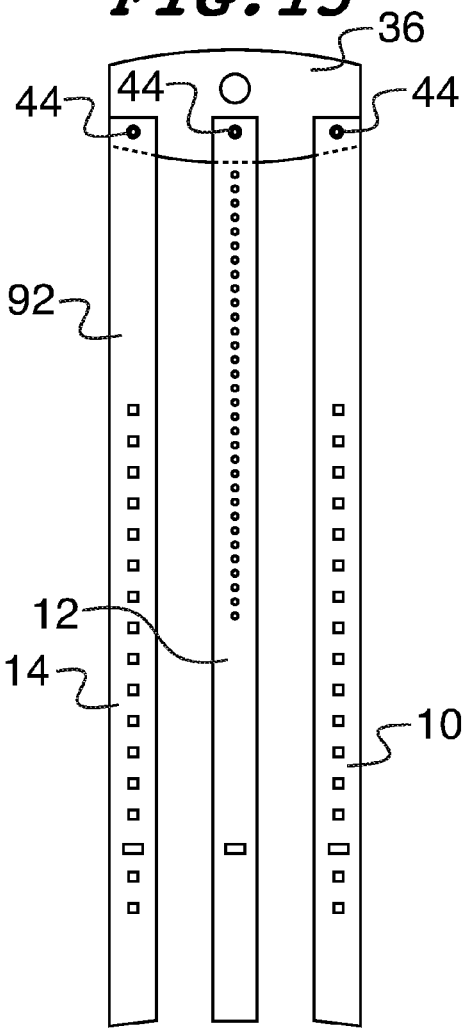
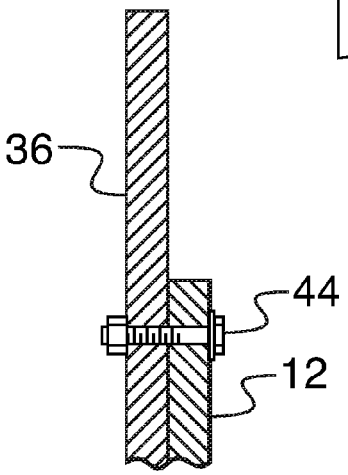
FIG. 12

ARTIST'S EASEL AND METHOD

I. BACKGROUND OF THE INVENTION

A. Field of the Invention

The invention is an easel to hold an artwork, such as a canvas or sketch pad. The invention is also a method of making the easel of the invention. The invention includes accessories for use with the easel, including a bench and a shelf.

B. Statement of the Related Art

Easels have been in use for many years to hold an artwork at a convenient height and orientation either for creation or display of an artwork. For the purposes of this document, the term 'artwork' means any creative work comprising matter applied to a substrate. As used in this document, the term 'substrate' means a canvas fabric stretched on a frame, paper, such as paper contained within a sketch book, wood, hardboard, tile, metal, or any other object that an artist may wish to support for the purpose of applying paint or other matter to the object to create the artwork. Easels are particularly useful for easel painting; namely, for supporting an artwork for the purpose of creative painting in any of several techniques, including but not limited to oils, tempura, gouache, watercolors and pastels.

Tripod easels are well known in the art. A tripod easel features three legs. The top ends of the legs are joined together. The bottom ends of the three legs are in a spaced apart relation to define the self-supporting tripod. The top end of the legs may be joined by a hinge about which one or more of the legs rotates, allowing the tripod easel to move between a first position in which the legs of the tripod easel do not define a self-supporting tripod and a second position in which all three of the legs are in a spaced-apart relation and in which the legs define a self-supporting tripod.

Display easels also have been used for many years to support completed artworks for display. A display easel may be a tripod easel.

II. SUMMARY OF THE INVENTION

The invention is a tripod easel for either production or display of an artwork. The three legs of the tripod easel can elastically bend along their lengths between a first position and a second position. In the second position the three legs are in a spaced-apart relation and hence define a self-supporting tripod.

Elastically Deformable Legs

The easel of the invention has a first leg, a second leg and a third leg. Each of the three legs has a longitudinal axis, a bottom end, a top end and a length along the longitudinal axis between the bottom and top ends. The top ends of the three legs are joined one to the others. The bottom end of the three legs are not attached one to another. The easel defines a front side and a back side, with the front side being oriented toward the artist when the artist is working at the easel and the back side being oriented away from the artist. The easel also defines an easel axis oriented in the front-and-back direction. Each of the three legs has a width generally normal to the easel axis and a thickness generally parallel to the easel axis. The width of each of the legs is large compared to the thickness.

The easel has a first position and a second position. When the easel is in the first position, the longitudinal axes of the three legs generally define straight lines and the lower end of the three legs are not spaced apart substantially in the forward or rearward directions. The three legs do not define a self-supporting tripod when in the first position. The first position is useful for storage and transportation of the easel.

The easel has a second position in which the three legs define a self-supporting tripod with the first and third legs disposed on either side of the second leg. To move to the second position from the first position, the three legs are resiliently and elastically deformed in flexure with respect to each other so that the longitudinal axes of the legs define arcs, with the first and third legs being curved in the forward direction (toward the artist) and the second leg being curved in the rearward direction (away from the artist). As used in this document, the term 'flexure' as applied to a leg means bending of the leg along its length.

The legs are maintained in the second position by one or more spacers that engage all three legs. The one or more spacers may define shelves. Because the bottom ends of the legs are in a spaced-apart relation, the three legs define a self-supporting tripod when the legs are in the second position.

The three legs effectively are three cantilevered flat springs that are joined at the top end. Because of the difference between the width and depth of the legs, each of the legs elastically deforms in the direction normal to the width of the leg and does not deform significantly in the direction parallel to the width of the leg. As used in this document, the terms 'elastic,' 'elastic deformation,' 'elastically deforms' and 'elastically deformable' mean that each leg deforms reversibly in response to a load exerted on the leg. When the load is removed, the leg returns to its original, un-loaded shape.

The legs deforms in a curve when a force is applied to the first and third legs in the forward direction and an equal force is applied to the second leg in the rearward direction. The curvature and amount of deformation of each leg is determined by its bending stiffness, also known as flexural rigidity. As used in this document, the term 'bending stiffness' has the meaning generally used in the field of applied mechanics. The legs retain the curved shape when the legs are held in the second position by the one or more spacers. The second leg provides the force that retains the first and third legs in the curved shape. The first and third legs provide the equal and opposite force that retains the second leg in the curved shape.

The three legs may be joined at the top end by a panel that falls within the plane of the legs when the legs are in the first position. The panel and the three legs may be formed from a unitary piece of a planar material, such as a sheet of plywood, of fiber-reinforced resin, or of a polymer. A single piece of 'Baltic birch' plywood has proven to have suitable stiffness and resiliency in practice to define all three legs and the top panel. Apple Ply® by State Industries LLC of Eugene, Oreg., and other high quality plywoods such as finply also are believed to be suitable.

When the three legs are moved to the second position, the resulting torques applied to the panel cause the panel to bend. The stiffness of each of the three legs and the panel, and hence the curves of the legs and panel when the legs are in the second position, are selected so that the legs and the panel assume an aesthetically pleasing shape when in the second position.

As a second embodiment, the second leg may be joined to the first and third leg so that the second leg can pivot with respect to the first and third legs in a plane normal to the easel axis, but not in the fore and aft direction. For example, the third leg may be bolted to the panel. This second embodiment otherwise functions as described above.

As a third embodiment, the first, second and third legs may be joined together so that the three legs can pivot with respect to each other in planes normal to the easel axis, but not in the fore and aft direction. For example, the first, second and third legs each may define a hole at the top end of each of the legs through which a bolt passes, the bolt fastening the three legs together and allowing the legs to pivot with respect to each other in a direction generally normal to the easel axis. This third embodiment otherwise functions as described above.

As a fourth embodiment, one or all of the legs are releasably attached to the other legs or leg. In all embodiments, the three legs are moved to the second position from the first position by elastic deformation of the first and third legs in the forward direction and by elastic deformation of the second leg in the rearward direction and not by movement of the legs in the fore and aft directions on a hinge or pivot.

Spacer Shelf

A shelf may serve as the spacer retaining the easel in the second position and transmitting force between the second leg and the combination of the first and third legs. The spacer shelf features appropriately-located pegs that matably engage corresponding spacer holes defined by the first, second and third legs. Force applied to the shelf by the elastically-deformed legs retains the spacer shelf in position and holds the easel in the second position.

Rows of Holes

The first and third legs each may be provided with a row of holes penetrating the leg along the longitudinal axis of the leg. The resulting two rows of holes present an aesthetically pleasing appearance and also provides mounting locations for shelves, for the artwork support structure, and for other accessories. Each of holes in the row of holes preferably is square.

Accessory Shelf

An accessory shelf features two pegs to engage a corresponding pair of holes of the rows of holes penetrating the first and third legs. The weight of the accessory shelf causes the pegs to rotate within the holes and to frictionally engage the holes, holding the accessory shelf in position. The accessory shelf may be mounted to the back side of the first and third legs and between the first and third legs and the second leg when the easel is in the second position. The accessory shelf is particularly useful for storing tubes of paint for use by the artist. More than one accessory shelf may engage the first and third legs if the artist desires more shelf space.

Artwork Support Apparatus

An item of artwork is supported on the easel by the artwork support apparatus. The artwork support apparatus comprises an artwork shelf, a rear support bar and a rotatable cam. The artwork shelf is configured to span the front side of the first and third legs. The artwork shelf includes a pair of pegs configured to engage two corresponding holes in the rows of holes penetrating the first and third legs. The artwork shelf supports the lower end of the artwork on the easel.

The artwork shelf is clamped to the first and third legs by the action of a cam acting on the top end of the artwork. The cam is an eccentric with a shaft. The eccentric may be of any suitable shape, but a cylindrical solid with the shaft offset from the center of the cylinder has proven suitable in practice. The shaft rotatably engages a mating hole defined by the second leg. The artist places the artwork on the artwork shelf and rotates the cam until the cam engages the top edge of the artwork. The cam presses the artwork against the artwork shelf, clamping the artwork to the artwork shelf and clamping the artwork shelf to the first and third legs.

The mating hole in the second leg receiving the shaft of the cam is a one of a plurality of mating holes and the shaft can matably engage any of the holes. The provision of the plurality of holes in the second leg allows the cam to be located at any of a plurality of locations along the second leg and to retain artworks of various sizes and at various heights on the easel.

The artwork supporting apparatus also allows adjustment of the orientation of the artwork by adjustment of the cam. The shaft extends in the forward direction from the second leg by an amount that can be selected by the user. The shaft of the cam is resilient and can bend elastically along its length. The portion of the shaft extending in the forward direction from the second leg therefore defines a spring that, in combination with the eccentric, presses the artwork against the artwork shelf. Because the free length of the shaft extending in the forward direction may be selected by the user, the location of the top of the artwork in the forward direction also may be selected by the user, allowing the user to orient the artwork in a more upright or less upright position.

A small artwork supported by the artwork support apparatus may not be wide enough to span the first and third legs. To avoid any danger of the small artwork falling between the first and third legs, a rear support bar is provided. The rear support bar is elongated and has two pegs configured to engage corresponding holes in the first and third legs. The rear support bar is disposed behind the artwork when the artwork is clamped between the cam and the artwork shelf and prevents the artwork from falling through the gap between the first and third legs. The rear support bar also places the artwork in a more upright position.

Parallel First and Third Legs

The longitudinal axes of the first and third legs may be configured to be parallel when the first and third legs are in the first position, as by use of the panel separating the top end of the first and third legs. The arcs defined by the first and third legs when in the second position are generally equal and the chords defined by the arcs are generally parallel for corresponding locations along the longitudinal axes of the first and third legs. The rows of holes in the first and third legs thus are parallel in the first position and holes of the rows of holes at corresponding locations along the lengths of the first and third legs are equidistant from each other. The use of parallel first and third legs and equidistant holes allows the accessory shelf and artwork support apparatus to be selectably located an any of a plurality of locations on the first and third legs, allowing the user flexibility in mounting the artwork support structure, shelves and accessories on the easel.

Cantilevered Shelf

A cantilevered shelf provides support for artist's supplies on the front side of the first or third legs. The cantilevered shelf features a shelf body. The shelf body has a top side and defines a plurality of appropriately-shaped openings or depressions to receive and to support artist's supplies, such as brushes, solvents, knives, paints, or any other tools or supplies that the artist may need while using the easel.

Attached to the shelf body is a first bearing surface and a second bearing surface. The second bearing surface is supported by a support structure to be generally parallel to the first bearing surface. The second bearing surface is located above and in a spaced apart relation to the first bearing surface. The first bearing surface is configured to engage the front side of the leg. The second bearing surface is configured to engage the back side of the leg. When the cantilevered shelf is in place on a leg, the weight of the shelf body applies a compression load to the first bearing surface, pressing the first bearing surface against the front side of the leg. The weight of the shelf body applies tension to the structure supporting the second bearing surface, pulling the second bearing surface against the back side of the leg. The force applied by the first and second bearing surfaces serves to clamp the cantilevered shelf to the leg.

The first and second bearing surfaces may define a lateral angle with respect to the shelf body, so that the shelf body extends to the side of the easel and does not interfere with the artist when the artist is in front of the easel.

The first bearing surface, the second bearing surface or both may be equipped with a peg that engages one of the holes of the row of holes in the leg. The force applied by the first and second bearing surfaces maintains the peg in engagement with the leg, further supporting the cantilevered shelf. The second bearing surface defines a cantilevered shelf hook protuberance that engages an inside surface of the first or third legs when the cantilevered shelf is in engagement with the leg. The hook protuberance prevents twisting of the cantilevered shelf due to the lateral angle at which the cantilevered shelf extends from the leg.

The cantilevered shelf may be readily removed or adjusted by the user by lifting the shelf to relieve the compression and tension loads from the bearing surfaces, to disengage the peg from the hole, and to disengage the hook protuberance from the inside surface of the leg.

The shelf body may define a second set of first and second bearing surfaces disposed on the other end of the cantilevered shelf as a mirror image to the first set of bearing surfaces. The second set of bearing surfaces allows the cantilevered shelf selectably to be mounted to the other of the first and third legs while maintaining the top side of the shelf body toward the top of the easel. The second set of bearing surfaces also is useful to support a cloth or rag when the second set of bearing surfaces is not being used to support the cantilevered shelf. The second set of bearing surfaces also may be equipped with a peg and with a hook protuberance in the same manner as the first set of bearing surfaces.

Cantilevered Palette Holder

The easel may feature a cantilevered palette holder. The palette holder is a flat shelf to support the palette of the artist. The palette holder is supported in a fashion similar to that of the cantilevered shelf. The palette holder defines a slot to allow the user to selectably place and remove the palette holder from either the first or the third legs. The opposing sides of the slot define first and second palette holder bearing surfaces. The weight of the palette holder applies a compression load to the bottom portion of the first bearing surface and to the front side of the leg. The weight of the palette holder places the structure defining the opposing second bearing surface under tension, which pulls the upper portion of the second bearing surface against the back side of the leg, clamping the palette holder to the leg. The slot is disposed at an angle to the palette holder, preferably at the same lateral angle as the cantilevered shelf. The angled slot causes the palette holder to extend to the side of the easel, avoiding interference with the artist when the artist is in front of the easel. The angled slot may define a palette holder peg and a palette holder hook protuberance that operate like the corresponding structures of the cantilevered shelf to hold the palette holder in position on the leg and to prevent twisting of the palette holder.

Because the palette holder is thin compared to the cantilevered shelf, the palette is reversible and may be turned over and attached to the other of the first and third legs for the convenience of the artist.

Accessories

The easel may be accompanied by accessories such as a stand-alone shelf and a stool. The shelf and stool may feature legs having a similar row of holes to those of the first and third legs of the easel. The legs of the shelf and stool will define an angle with respect to the floor similar to the angle defined by the first and third legs of the easel when the easel is in the second position. The stand alone shelf and stool therefore may be used to support the cantilevered shelf, the palette holder and any other shelves or accessories that may be supported by the easel. The stand alone shelf and stool serve to organize the artist's workspace, allowing the artist to be more productive. The stand alone shelf and stool also may support other shelves in the same manner as the accessory shelf for the convenience of the artist.

The legs of the stand alone shelf and stool may serve as alternative locations for the cantilevered shelf and cantilevered palette holder. For example, the artist may mount a large artwork to the easel blocking some or all of the rows of holes in the first and third legs and rendering those holes unavailable for supporting the cantilevered shelf and palette holder. The artist may mount the cantilevered shelf and the palette holder to the legs of the stand alone shelf or stool so that the cantilevered shelf and palette holder are available for use.

Tetrapod Easel

The easel may have four legs rather than three, with two legs being displaced in the forward direction and two displaced in the rearward direction when the easel moves from the first position to the second position. As for the three-legged embodiment, the four legs are not hinged in the forward and rearward directions and the four legs elastically deform to form arcs in the second position and to thereby define the tetrapod (four legged) easel. In all other respects, the tetrapod easel operates in the same manner as the tripod easel.

III. BRIEF DESCRIPTION OF THE DRAWINGS

FIG. 2 is a perspective view of the legs in the first position.

FIG. 3 is a perspective view of an alternative embodiment of the legs in an unfolded position.

FIG. 3*a* is a perspective view of the alternative embodiment of FIG. 3 in the folded position.

Figure 4:
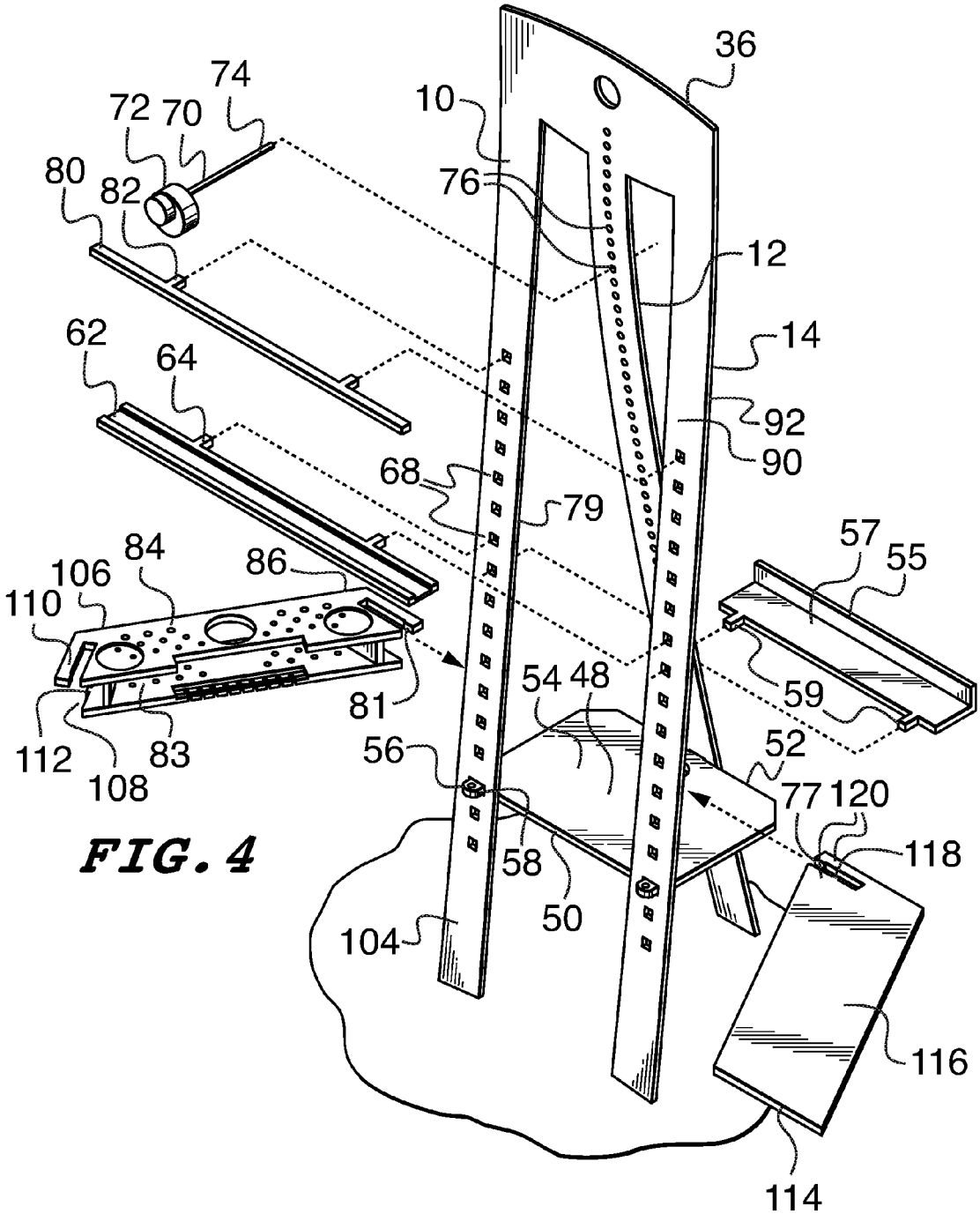

FIG. 4 is an exploded view of the easel in the second position with shelves, palette holder and artwork support.

Figure 5:
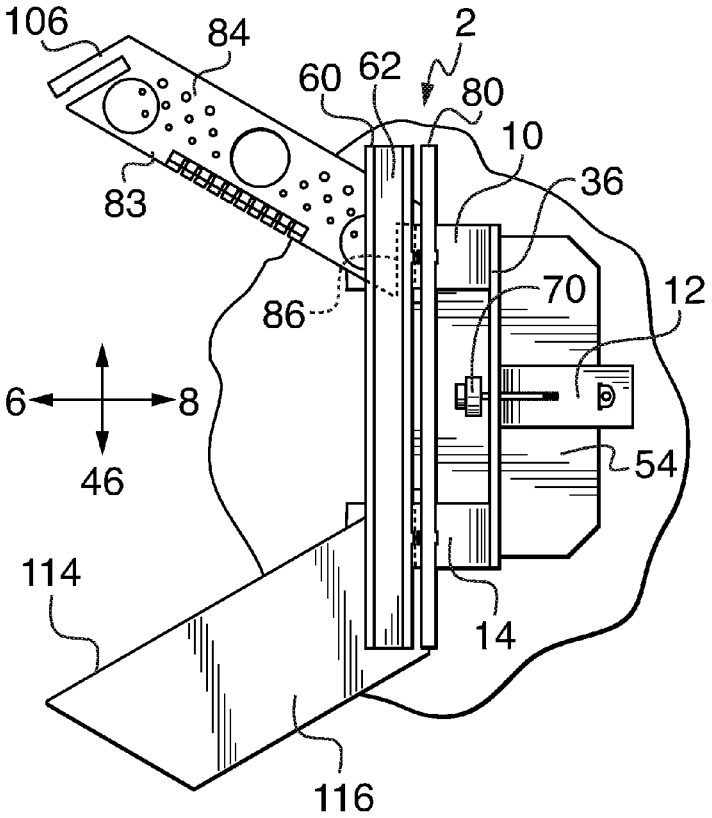

FIG. 5 is a top view of the easel in the second position.

Figure 6:
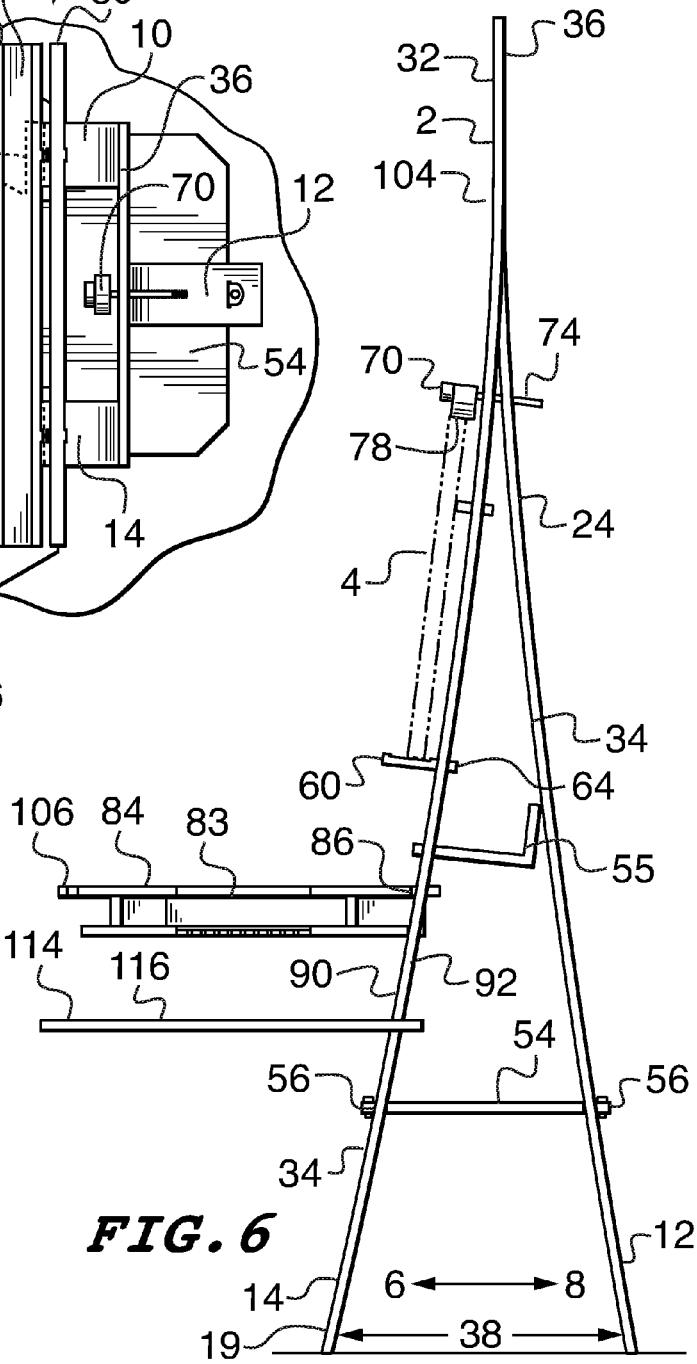

FIG. 6 is a side view of the easel in the second position.

Figure 7:
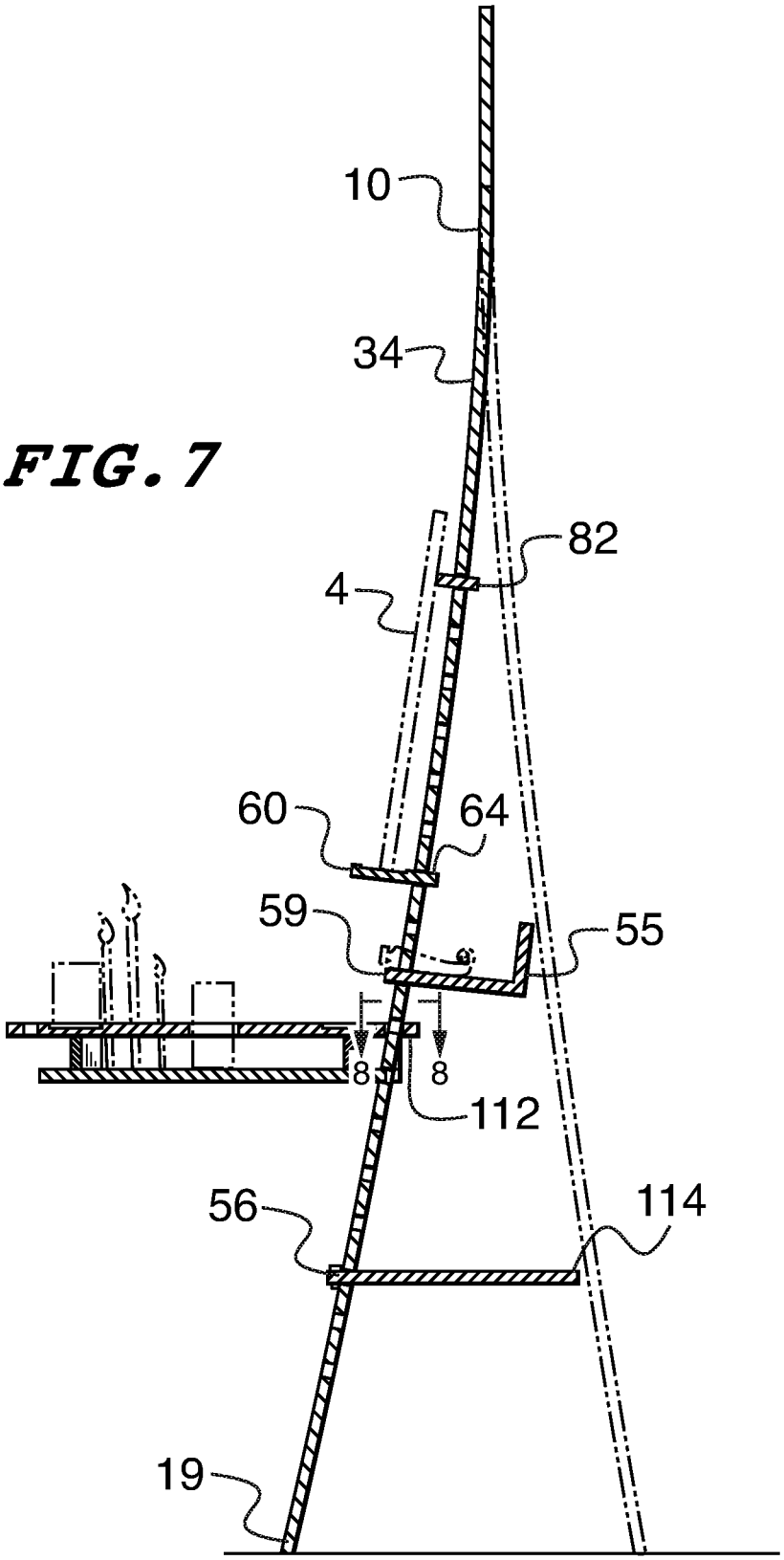

FIG. 7 is a side section view of the easel in the second position.

FIG. 8 is a detail plan view of the cantilevered shelf on the first leg.

FIG. 9 is a detail side view of the cantilevered shelf on the first leg.

FIG. 10 is a detail side view of the palette holder on the third leg.

FIG. 11 is a rear view of the three legs of a first alternative embodiment in the first position.

FIG. 12 is a detail of the hinge of FIG. 11.

FIG. 13 is a rear view of the three legs of a second alternative embodiment in the first position.

Figure 14:
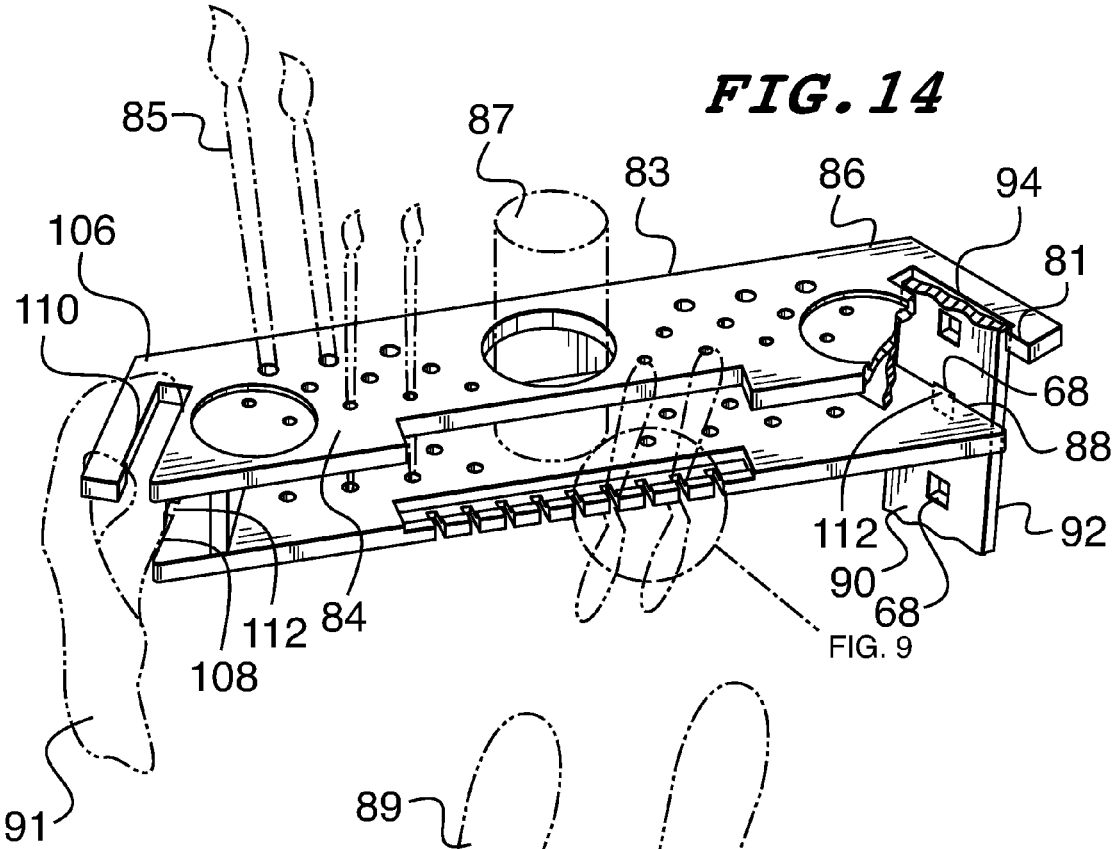

FIG. 14 is a perspective view of the cantilevered shelf.

Figure 15:
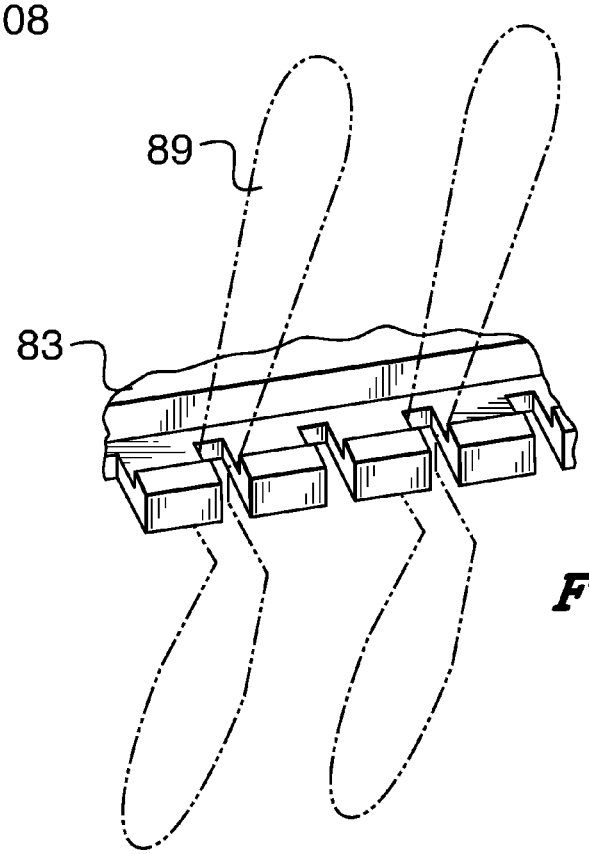

FIG. 15 is a detail view of the cantilevered shelf.

Figure 16:
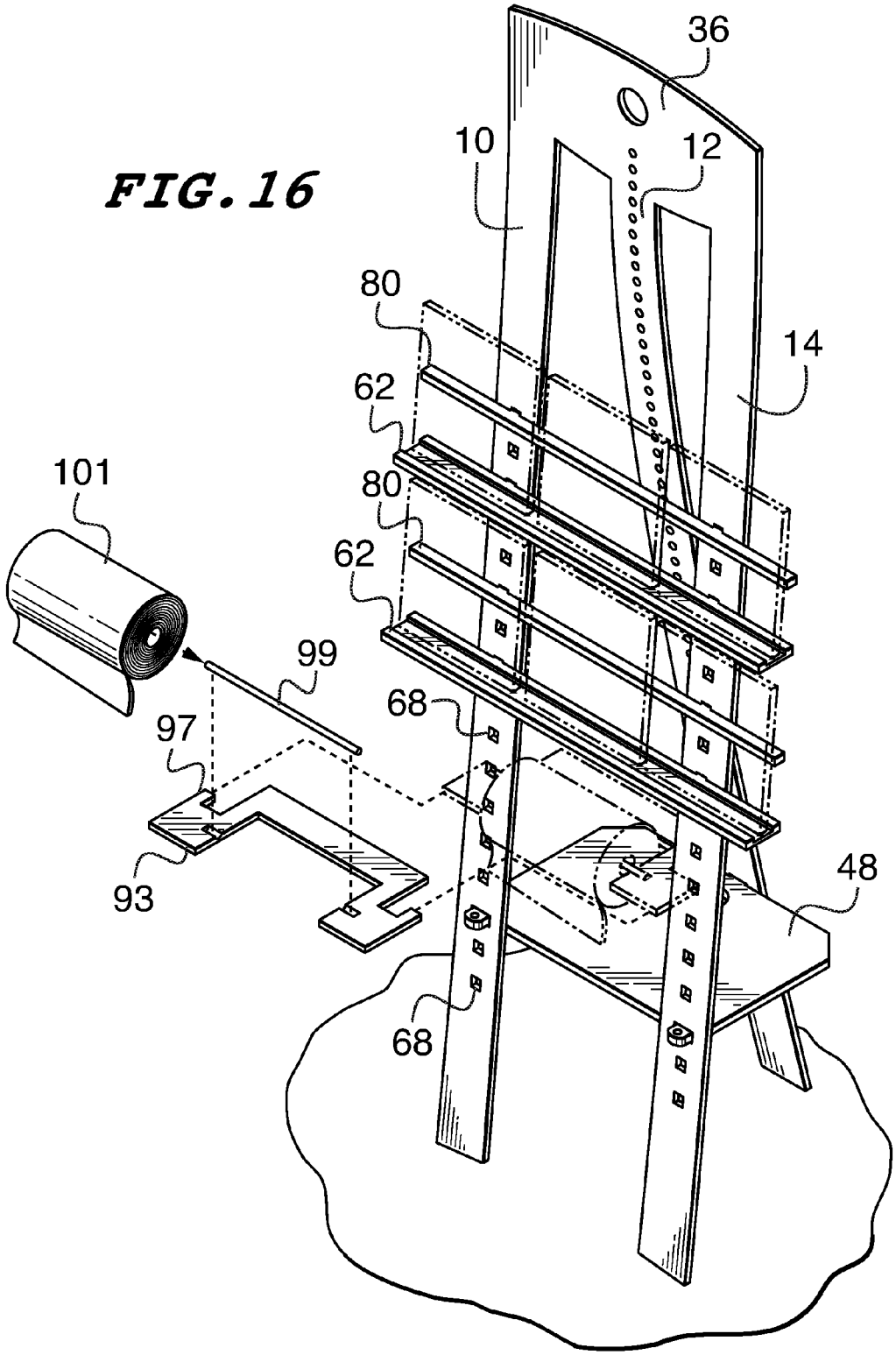

FIG. 16 is a perspective view of the easel in the second position with an accessory and supporting two artworks.

Figure 17:
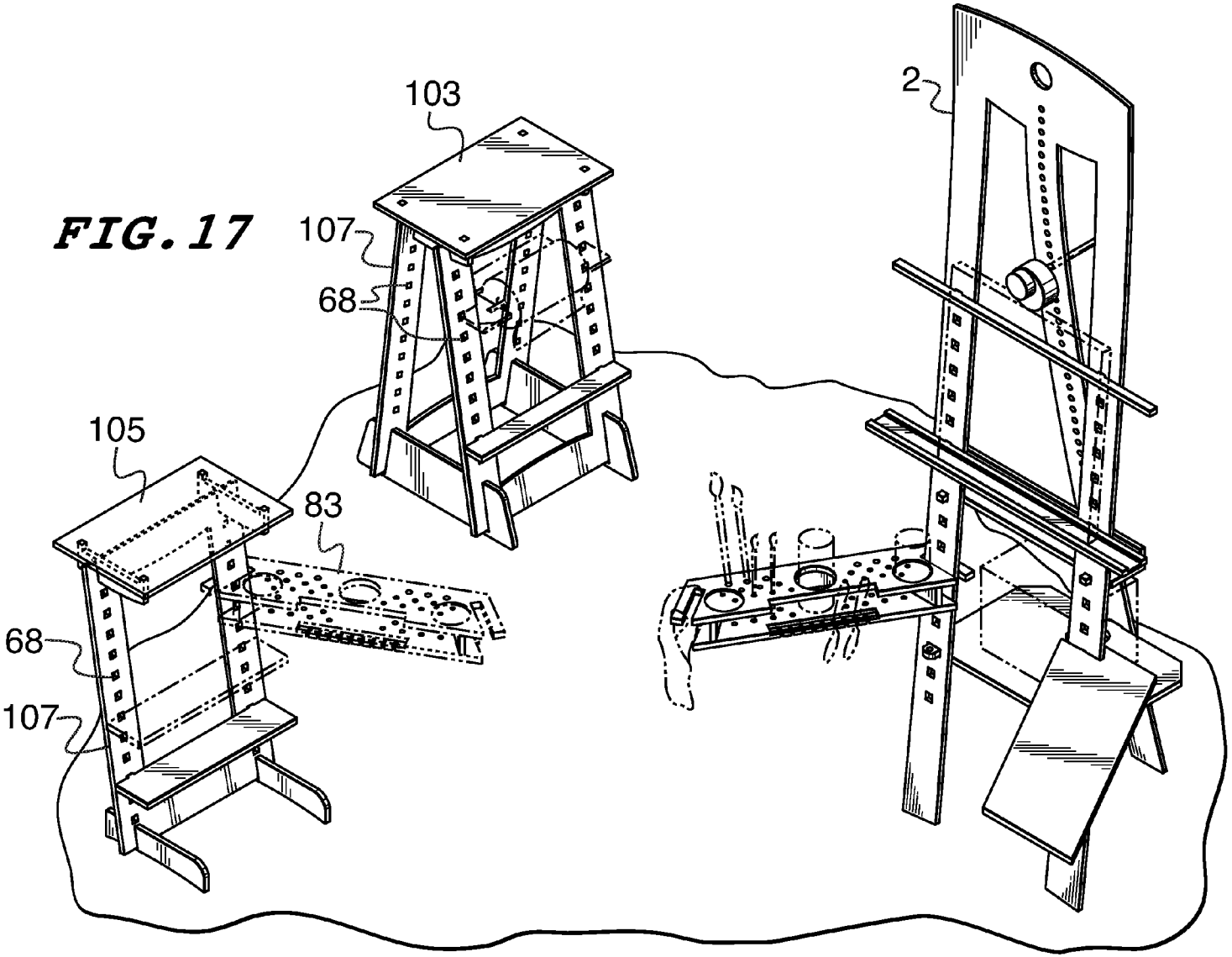

FIG. 17 is a perspective view of the easel in the second position with a family of free-standing and attached accessories.

IV. DESCRIPTION OF AN EMBODIMENT

Figure 1:
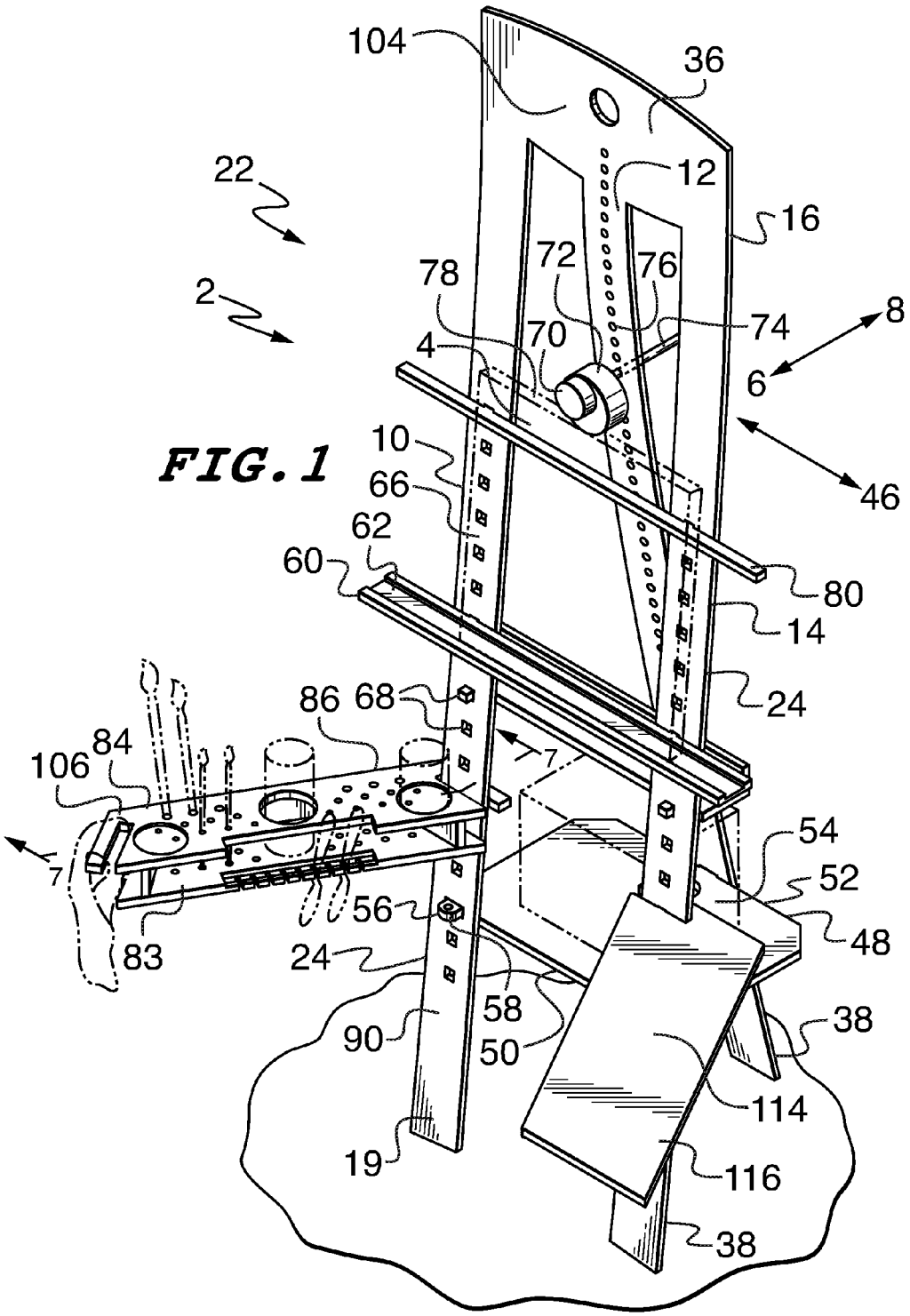
FIG. 1 is a perspective view of the easel in the second position.

FIG. 1 is a perspective view of the easel 2 of the invention. The easel 2 is configured to support an artwork 4 for easel painting, for display, or for any other purpose. The easel 2 defines a forward direction 6 and an opposing rearward direction 8. The easel 2 is a tripod easel having first leg 10, second leg 12 and third leg 14. Each leg 10, 12, 14 has a top end 16, a length 18 (shown by FIG. 2) and a bottom end 19.

The legs 10, 12, 14 have a second position 22, as shown by FIGS. 1, 4-7, 16 and 17. The legs 10, 12, 14 also have a first position 20, as shown by FIG. 2, and as shown for alternative embodiments by FIGS. 3, 11 and 13. In the second position 22, the three legs 10, 12, 14 define a free-standing tripod 24 because each of the legs 10, 12, 14 is in a spaced-apart relation 38 to each of the other legs 10, 12, 14. In the first position 20, as illustrated by FIG. 2, the legs 10, 12, 14 are not in a spaced-apart relation 38 in the forward and rearward directions 6, 8, and hence the legs 10, 12, 14 are not adequately spaced apart to securely support artwork 4.

Each leg 10, 12, 14 has a longitudinal axis 30, shown by FIG. 3, and running generally from top end 16 to the bottom end 19 of the leg 10, 12, 14. From FIG. 2, each leg 10, 12, 14 has a thickness 26 along the forward and rearward directions 6, 8 and a width 28 in a direction 46 normal to the forward and rearward directions 6, 8. The width 28 is larger than the thickness 26.

Each leg 10, 12, 14 is composed of a material that will bend in flexure when a force is applied to the first 10 and third 14 legs in the forward direction 6 and an equal and opposite force is applied to the second leg 12 in the rearward direction 8. Because the width 28 is greater than the thickness 26, the legs 10, 12, 14 have a stiffness in flexure along the length of the legs 10, 12, 14 in the forward 6 and rearward 8 directions that is less than the stiffness in flexure in the direction normal 46 to the forward and rearward directions 6, 8. As a result, the legs 10, 12, 14 will bend much more readily in the forward and rearward directions 6, 8 than in the direction 46 normal to the forward and rearward directions 6, 8.

When the legs 10, 12, 14 bend in response to the applied force, the longitudinal axes 30 of the legs 10, 12, 14 also bend to define arcs 34 in side projection, as illustrated by FIGS. 6 and 7. The arcs 34 cause the bottom end 19 of the legs 10, 12, 14 to define a spaced-apart relation 38 in the forward 6 and rearward 8 directions, and thus define the free-standing tripod 24. In the first position 20, the longitudinal axes 30 of legs 10, 12, 14 do not define arcs 34 in the forward 6 and rearward 8 directions sufficient to define a free-standing tripod 24.

The legs 10, 12, 14 may be composed of any material having suitable resilience, strength and damping characteristics. To be suitable, the material must be adequately resilient to elastically deform between the first position 20 and the second position 22. The material must be adequately strong to support the artwork 4 and the accessories, as described below. In addition, the material must have adequate damping characteristics so that the easel 2 does not oscillate significantly when disturbed. In practice, 'Baltic birch' plywoods, which are widely available birch plywoods from Russia and Finland, have proven suitable for the legs 10, 12 14 and for the other components and accessories of the easel 2. Other high-quality plywoods also are suitable. Other materials believed to be suitable include polymers such a polypropylene or polyethylene and fiber-reinforced resins, such as carbon fiber or glass fiber-reinforced resins.

As shown by FIGS. 1-4, 16 and 17, the top ends legs 10, 12, 14 may be joined by a top panel 36. The top panel 36 allows first leg 10 and third leg 14 to be in a spaced-apart relation in the direction 46 normal to the forward 6 and rearward 8 directions while at the same time allowing the longitudinal axes 30 of the first and third legs 10, 14 to be generally parallel when the legs 10, 12, 14 are in the first position 20. Providing that the longitudinal axes 30 of the first and third legs 10, 14 are parallel in the first position 20 allows the chords defined by the arcs 34 at corresponding locations along the longitudinal axes 30 when the legs 10, 12, 14 are in the second position 22 to be generally parallel. This facilitates connection of the artwork 4 and accessories to the easel 2, as described below.

The three legs 10, 12, 14 and the top panel 36 may be unitary and formed from a single piece of Baltic birch plywood. Alternatively, one or more of the legs 10, 12, 14 may be attached to the top panel 36, as by hinge 44, shown by FIGS. 11, 12 and 13. The hinge 44 may take the form of one or more bolts. The hinge 44 may allow the leg 10, 12, 14 to rotate in a direction normal 46 to the forward 6 and rearward 8 directions, but does not allow the leg 10, 12, 14 to rotate in the forward 6 or rearward direction 8. Rotation of a leg 10, 12, 14 about the hinge 44 cannot define the spaced apart relation 38 in the forward 6 or rearward 8 directions that defines self-supporting tripod 24. For this embodiment, the self-supporting tripod is defined by elastic deformation of the legs 10, 12, 14 in the forward 6 and rearward 8 directions, as described above.

FIGS. 3 and 3A show an alternative embodiment in which the legs 10, 12, 14 may be folded between a stored position, illustrated by FIG. 3A, and a deployed position, illustrated by FIG. 3. Hinged connections 45 allow legs 10, 12, 14 to fold along their lengths 18. Hinged connections 45 are arranged so that the hinged connection 45 is located on the side of the leg 10, 12, 14 that is under tension when the leg 10, 12, 14 is in the second position 22. For the second leg 12, the hinged connection 45 is located on the front side 90 of the second leg 12. For the first and third legs 10, 14, the hinged connection 45 is located on the back side 92 of the leg 10, 14.

After force is applied to the legs 10, 12, 14 to move the legs 10, 12, 14 from the first position 20 to the second position 22, the legs 10, 12, 14 are retained in the second position 22 by a spacer 48, shown by FIGS. 1, 4, 5, 16 and 17. Spacer 48 has a spacer front side 50 and a spacer back side 52. The spacer defines a first, second and third spacer pin 56. Each of the first, second and third legs defines a spacer hole 58, configured to receive one of the spacer pins 56. When the easel 2 is in the second position 22, the front side 50 of the spacer 48 engages the first and third legs 10, 14, while the back side 52 of the spacer 48 engages the second leg 12. Each of the first, second and third spacer pins 56 engages a corresponding spacer hole 58 in the first, second or third legs 10, 12, 14. The force exerted by the elastically deformed first, second and third legs 10, 12, 14 against the front and back sides 50, 52 of the spacer 48 holds the spacer 48 in position and maintains the easel 2 in the second position 22.

The spacer 48 may define a spacer shelf 54, as shown by FIGS. 1 and 4. As shown by FIG. 1, the spacer shelf 54 may support a box or case of artists supplies such as a student may bring to an art class. The student may unload artists supplies from the box or case and place those supplies on the accessory shelf 55, cantilevered shelf 83, or palette holder 114.

The first and third legs 10, 14 each defines a row of supporting holes 68. The supporting holes 68 are preferably square in plan view with each supporting hole 68 in the first leg 10 an equal distance from the corresponding supporting hole 68 in the third leg 14. The equidistant corresponding pairs of supporting holes 68 allow the components and accessories to the easel 2, as described below, to be located in any of a plurality of locations as selected by the artist or other user. The easel 2 therefore may be configured as desired by the artist or other user.

An accessory shelf 55 may be provided for the convenience of the artist. The accessory shelf 55 is illustrated by FIGS. 4, 6 and 7. The accessory shelf 55 has an accessory shelf body 57 and defines a pair of accessory shelf pegs 59, the second spacer shelf pegs 59 are configured to engage a corresponding pair of the supporting holes 68 on the back side 92 of the first and third legs 10, 14. The weight of the accessory shelf 55 causes the accessory shelf pegs 59 to rotate within the supporting holes 68, clamping the accessory shelf 55 to the first and third legs 10, 14.

The apparatus to support the artwork 4 on the easel 2 is illustrated by FIGS. 1, 4-7, 16 and 17. The artwork supporting apparatus includes an artwork shelf 60 having an artwork supporting surface 62 and a defining a pair of artwork shelf pins 64. The pair of artwork shelf pins 64 are configured to engage a corresponding pair of the supporting holes 68 in the first and third legs 10, 14. The artwork supporting apparatus also includes a cam 70 and a rear support bar 80. The cam 70 includes an eccentric 72 and a shaft 74 attached to the eccentric 72. The second leg 12 features a plurality of cam shaft holes 76 configured to matably engage with the shaft 74. The rear support bar 80 spans the first and third legs 10, 14 and defines rear support bar pegs 82. The rear support bar pegs 82 are configured to engage a pair of corresponding supporting holes 68 in the first and third legs 10, 14.

To support an artwork 4 on the easel 2, the artwork shelf pins 64 are placed into engagement with corresponding supporting holes 68 in the first 10 and third 14 legs. An artwork 4 is placed on the artwork supporting surface 62 of the artwork shelf 60. The rear support bar 80 is placed in engagement with the first and third legs 10, 14 above the artwork shelf 60 at an elevation selected to prevent the artwork 4 from falling between the first and third legs 10, 14. The rear support bar pegs 82 are placed in engagement with a corresponding pair of supporting holes 68 in the first and third legs 10, 14. The shaft 74 of the cam 70 is inserted through one of the cam shaft holes 76 in the second leg 12. The cam shaft hole 76 is selected to allow the eccentric 72 to contact the top edge 78 of the artwork 4 when the cam 70 is rotated. The eccentric 72 is rotated until the eccentric 72 engages the top edge 78 of the artwork 4. The engagement between the eccentric 72 and the top edge 78 of the artwork 4 clamps the artwork 4 against the artwork supporting surface 62 of the artwork shelf 60, and clamps the artwork shelf 60 to the first and third legs 10, 14.

The artwork supporting apparatus also allows adjustment of the orientation of the artwork 4 by adjustment of the cam 70. The shaft 74 extends in the forward direction from the second leg 12 by an amount that can be selected by the user. The shaft 74 of the cam 70 is resilient and can bend elastically along its length. The portion of the shaft 74 extending in the forward direction from the second leg 12 therefore defines a spring that, in combination with the eccentric, presses the artwork 4 against the artwork shelf 60. Because the free length of the shaft 74 extending in the forward direction may be selected by the user, the location of the top of the artwork 4 in the forward direction also may be selected by the user, allowing the user to orient the artwork 4 in a more upright or less upright position.

The rear support bar 80 supports the artwork 4 from behind and prevents an artwork 4 that is smaller than the distance between the first and third legs 10, 14 from falling between the first and third legs 10, 14.

The easel 2 may be equipped with a cantilevered shelf 83, illustrated by FIGS. 1, 4-9, 14, 15 and 17. The cantilevered shelf 83 includes a cantilevered shelf top side 84 and a cantilevered shelf first end 86. The top side 84 of the cantilevered shelf 83 is configured to receive and to hold any supplies that the artist may find convenient, such as brushes 85, solvents 87, palette knives 89, a cloth or a beverage cup. The first end 86 of the cantilevered shelf 83 defines a first bearing surface 88 and a second bearing surface 94. The first bearing surface 88 is configured to engage the front side 90 of the first or the third legs 10, 14. The second bearing surface 94 is configured to engage the back side 92 of the first or third legs 10, 14. The first and second bearing surfaces 88, 94 are generally parallel and are separated vertically by a separation distance 96.

As shown by FIGS. 8 and 9, the separation distance 96 is selected so that when the first bearing surface 88 is placed in engagement with the front side 90 of the first or third legs 10, 14 and the second bearing surface 94 is placed in engagement with the back side 92 of the leg 10, 14, the force of gravity pulling on the cantilevered shelf 83 (that is, the weight 100 of the cantilevered shelf 83) causes the first and second bearing surfaces 88, 94 to clamp the leg 10, 14 and to maintain the cantilevered shelf 83 in a pre-determined position. The first or second bearing surfaces 88, 94, or both, also may define a cantilevered shelf peg 112 that is configured to engage a one of the row of supporting holes 68 in the leg 10, 14, to further maintain the cantilevered shelf 83 in the pre-determined position.

The first or the second bearing surface 88, 94 may be equipped with a cantilevered shelf hook protuberance 81 that is configured to engage the inside surface 79 of the first or third leg 10, 14 when the cantilevered shelf 83 is in engagement with the leg 10, 14. The cantilevered shelf hook protuberance 81 prevents the cantilevered shelf 83 from twisting due to the lateral angle 102 at which the cantilevered shelf 83 extends from the leg 10, 14.

The cantilevered shelf 83 may define a lateral angle 102, shown by FIG. 8. The lateral angle 102 causes the cantilevered shelf 83 to extend to the side of the easel 2 to avoid interference between the cantilevered shelf 83 and the artist. The cantilevered shelf 83 may be configured to mount to either of the first or the third legs 10, 14 and to define the lateral angle 102 in either location. The second end 106 of the cantilevered shelf 83, shown by FIG. 14, defines a second end first bearing surface 108 and a second end second bearing surface 110. The second end bearing surfaces 108, 110 are mirror images of the first end bearing surfaces 88, 94, including the cantilevered shelf peg 112 and the cantilevered shelf hook protuberance 81. The cantilevered shelf 83 therefore may be interchangeably mounted to either the first or third legs 10, 14, with the first end 86 of the cantilevered shelf being configured for mounting to the first leg 10 and the second end 106 being configured for mounting to the third leg 14.

The end 86, 106 of the cantilevered shelf 83 that is not in engagement with a leg 10, 14 may be used to support a cloth or towel 91, as shown by FIG. 14. The cantilevered shelf 83 may contain openings to support palette knives 89, as shown by FIG. 15.

The easel 2 may support a palette holder 114, illustrated by FIGS. 1, 4-7, 10, 13 and 17. The palette holder 114 provides a convenient location for an artist to place the artists palette. As shown by FIG. 4, the palette holder 114 features a palette holder body 116 that defines a palette holder slot 118. As shown by FIG. 10, the palette holder slot 118 defines opposing first and second slot surfaces 120, which are separated by a slot separation distance 122. The slot separation distance 122 is selected so that the first or third leg 10, 14 will fit into the palette holder slot 118. The slot separation distance 122 is also selected so that the first and second slot surfaces 120 will rotate slightly to place the palette holder 114 in a horizontal orientation and to grip the leg front side 90 and leg back side 92 under the weight 124 of the palette holder 114.

The first or second slot surfaces 120 of the palette holder 114 may be equipped with a palette holder peg configured to engage a hole 68 from the row of holes in the first or third leg 10, 14 of the easel 2. The weight of the palette holder 114 maintains the palette holder peg in engagement with the hole 68, supporting the palette holder 114 on the leg 10, 14 in a similar fashion to the cantilevered shelf 83. The first or second slot surface 120 may be equipped with a palette holder hook protuberance 77 to prevent twisting of the palette holder 114, similar to the hook protuberance 81 of the cantilevered shelf 83.

The palette holder slot 118, and hence the palette holder 114, also defines the lateral angle 102 so that the palette holder body 116 extends to the side of the easel 2 and does not interfere with the artist when the palette holder 114 is supported by the first or third leg 10, 14. The palette holder 114 may be supported interchangeably by the first leg 10 or the third leg 114. The palette holder 114 may be inverted so that the palette holder 114 extends to either side of the leg 10, 14 supporting the palette holder 114.

FIG. 16 illustrates the flexibility provided by the rows of supporting holes 68 in the first and third legs 10, 14 and by the row of camshaft mating holes 76 in the second leg 12. Because of the multiple mounting locations allowed by the multiple holes 68, 76, the easel 2 may support more than one artwork 4 at the same time, as shown by FIG. 16. Also because of the multiple mounting locations, an artwork 4 may be supported at any of a variety of heights on the easel 2, also as illustrated by FIG. 16.

The rows of supporting holes 68 in the first and third legs 10, 14 may be used to support other accessories useful to the artist, such as a paper towel holder 93. From FIG. 16, the paper towel holder 93 includes a paper towel holder body 95. The paper towel holder body 95 defines a pair of paper towel holder body pegs 97 that are configured to selectably engage a corresponding pair of the supporting holes 68 on the first and third legs 10, 14. A rod 99 passes through the roll of paper towels 101 and rests in corresponding rod-receiving openings of the paper towel holder body 95.

FIG. 17 illustrates that the design features of the easel 2 may be used for free-standing accessories, such as a free-standing stool 103 and a free-standing shelf 105. The free-standing stool 103 and the shelf 105 both feature legs 107 having rows of supporting holes 68 having the same configuration as the rows of supporting holes 68 in the first and third legs 10, 14 of the easel 2. The legs 107 of the free-standing stool 103 and shelf 105 will define a similar angle in side projection with respect to the floor as the legs 10, 14 of the easel 2 when the easel 2 is in the second position 22. The legs 107 of the stool 103 and shelf 105 also will have a similar width 28 and thickness 26 as the first and third legs 10, 14 of the easel 2. As a result, accessories such as the cantilevered shelf 83, the palette holder 114, the paper towel holder 93 and the accessory shelf 55 may be supported by the legs 107 of the free-standing stool 103 and shelf 105 in the same manner that those accessories are supported by the first or third legs 10, 14 of the easel 2.

The stool 103 or shelf 105 of FIG. 17 may be composed of the same materials as the easel 2.

The following numbered elements are described in the specification and illustrated by the drawings:

an easel 2
an artwork 4
a forward direction 6
rearward direction 8
a first leg 10
a second leg 12
a third leg 14
top end 16
a length 18
a first position 20
a second position 22
a free-standing tripod 24
a thickness 26
a width 28
a longitudinal axis 30
a side projection 32
an arc 34
a top panel 36
a spaced apart relation 38
a unitary piece of a material 40
a plywood, a fiber-reinforced resin and a polymer 42
a hinge 44
a direction generally normal to said forward and rearward direction 46
a spacer 48
a spacer front side 50
a spacer back side 52
a spacer shelf 54
an accessory shelf 55
a first, a second and a third spacer pin 56
first, second and third spacer holes 58
an artwork shelf 60
an artwork supporting surface 62
a pair of artwork shelf pins 64
a front side 66
supporting holes 68
a cam 70
an eccentric 72
a shaft 74
a mating cam shaft hole 76
a top edge 78
a rear support bar 80
a pair of rear support pegs 82
a cantilevered shelf top side 84
a first cantilevered shelf end 86
a first bearing surface 88
a leg front side 90
a leg back side 92
a second bearing surface 94
a separation distance 96
a pre-determined position 98
a weight 100 of the cantilevered shelf
a lateral angle 102
an easel front side 104
a second cantilevered shelf end 106
a second end first bearing surface 108
a second end second bearing surface 110
a cantilevered shelf peg 112
a palette holder 114
a palette holder body 116
a slot 118
first and second slot surfaces 120
a slot separation distance 122
a weight of the palette holder 124
bottom end 19
second spacer shelf 55
second spacer shelf body 57
second spacer shelf pegs 59
palette holder hook protuberance 77
inside surface of the first or third leg 79 cantilevered shelf hook protuberance 81
cantilevered shelf 83
brushes 85
solvents 87
palette knives 89
cloth or towel 91
paper towel holder 93
paper towel holder body 95
paper towel body pegs 97
rod 99
roll of paper towels 101
free-standing stool 103
free-standing shelf 105
stool or shelf legs 107

I claim:

1. An easel apparatus for supporting an artwork, the apparatus having a forward direction and an opposing rearward direction, the apparatus comprising:

a. a first leg, a second leg and a third leg, said first, second and third legs each having a top end and a length, said top ends of said first, second and third legs being substantially fixed in the forward and rearward directions, said legs being elastically deformable in flexure in the forward or rearward directions between a first position and a second position;

b. said first and third legs each being curved in the forward direction when said legs are in said second position said first and said third legs not being curved in the forward direction when said legs are in said first position;

c. said second leg being curved in the rearward direction when said legs are in said second position said second leg not being curved in the rearward direction when said legs are in said first position, said legs when in said second position defining a free-standing tripod;

d. a spacer said spacer being disposed between said second leg and said first and third legs when said legs are in said second position, said spacer having a front side and a back side, said first and said third legs resiliently pressing against said front side of said spacer and said second leg resiliently pressing against said back side of said spacer when said legs are in said second position wherein said spacer is a spacer shelf and defines a first, a second and a third spacer pin, said first, second and third spacer pins engaging corresponding first, second and third spacer holes on said first, second and third legs when said legs are in said second position, said first, second and third spacer pins and said first, second and third spacer holes being maintained in engagement when in said second position by said first, second and third legs resiliently pressing against said spacer.

2. The easel apparatus of claim 1 wherein each of said first, second and third legs has a thickness generally parallel to the forward and the rearward directions and a width generally normal to the forward and to the rearward directions, said width of each of said first, second and third legs being greater than said thickness, whereby each of said first, second and third legs is elastically deformable along said length in the forward and rearward directions.

3. The apparatus of claim 1 wherein said first and said third legs each defines a longitudinal axis, said longitudinal axes of said first and said third legs being generally straight when viewed in a side projection when said first, second and third legs are in said first position, said longitudinal axes of said first and said third legs each defining an arc when viewed in said side projection when said first, second and third legs are in said second position, said arc of said first leg corresponding to said arc of said third leg when said first, second and third legs are in the second position, said arc defining said curve of said first and said third legs in said second position.

4. The easel apparatus of claim 3, the apparatus further comprising: a top panel, said top ends of said first and said third legs being attached to said top panel in a spaced apart relation, said longitudinal axes of said first and said third legs being generally parallel when said first and said third legs are in said first position.

5. The easel apparatus of claim 4 wherein said top end of said second leg is attached to said panel between said first and said third legs.

6. The easel apparatus of claim 5 wherein said panel and said first, said second and said third legs are composed of a unitary piece of a material wherein said unitary piece of material is selected from a list consisting of a plywood, a fiber-reinforced resin and a polymer.

7. The easel apparatus of claim 1, the apparatus further comprising: a hinge, at least a one of said first, second and third legs being connected to the other of said legs by said hinge, said hinge being configured to allow said at least one leg to pivot in a direction generally normal to the forward and rearward directions, said hinge not allowing said at least one leg to pivot in the forward or rearward direction.

8. The apparatus of claim 1, the apparatus further comprising: a palette holder, said palette holder defining a palette holder body, said palette holder body defining a slot, said slot being configured for releasable engagement with said first leg or said third leg, said slot defining opposing first and second slot surfaces, said first and said second slot surfaces being configured for selectable engagement with said first or said third leg.

9. An easel apparatus for supporting an artwork, the apparatus having a forward direction and an opposing rearward direction, the apparatus comprising:

a. a first leg, a second leg and a third leg, said first, second and third legs each having a top end and a length, said top ends of said first, second and third legs being substantially fixed in the forward and rearward directions, said legs being elastically deformable in flexure in the forward or rearward directions between a first position and a second position;

b. said first and third legs each being curved in the forward direction when said legs are in said second position said first and said third legs not being curved in the forward direction when said legs are in said first position;

c. said second leg being curved in the rearward direction when said legs are in said second position, said second leg not being curved in the rearward direction when said legs are in said first position, said legs when in said second position defining a free-standing tripod d. an artwork shelf, said artwork shelf being elongated and being configured to span said first and said third legs when said legs are in said second position, said artwork shelf defining an artwork supporting surface and a pair of artwork shelf pins attached to said artwork supporting surface in a spaced-apart relation, said first and third legs each having a front side, said artwork shelf pins being configured to engage a pair of supporting holes defined by said front side of said first and said third legs;

e. a cam, said cam comprising an eccentric and a shaft attached to said eccentric, said shaft being configured to rotatably engage a mating cam shaft hole communicating through said second leg, said eccentric being configured for rotation and to selectably engage a top edge of an artwork supported on said artwork supporting surface, whereby said artwork may be selectably clamped to said artwork supporting surface by said cam.

10. The easel apparatus of claim 9 wherein a. each of said supporting holes defined by said front sides of said first and third legs is a one of a row of supporting holes in said first and said third legs, and b. said cam shaft hole communicating through said second leg is a one of a plurality of said cam shaft holes, and b. said shaft of said cam is resilient in flexure and protrudes from said cam shaft hole in the forward direction to define a user-selectable free length, whereby said user-selectable free length defines a location in said forward direction of said top edge of said artwork and whereby said free length of said shaft resiliently urges said eccentric and hence said top edge of said artwork against said artwork supporting surface.

11. The easel apparatus of claim 10, the apparatus further comprising: a rear support bar, said rear support bar defining a pair of rear support pegs and being configured to span said first and third legs, said rear support pegs being configured to selectably engage another of said row of supporting holes defined by said front sides of each of said first and third legs, said rear support bar being configured to be located on said front sides of said first and third legs between said artwork supporting surface and said cam.

12. An easel apparatus for supporting an artwork, the apparatus having a forward direction and an opposing rearward direction, the apparatus comprising:

a. a first leg, a second leg and a third leg, said first, second and third legs each having a top end and a length, said top ends of said first, second and third legs being substantially fixed in the forward and rearward directions, said legs being elastically deformable in flexure in the forward or rearward directions between a first position and a second position;

b. said first and third legs each being curved in the forward direction when said legs are in said second position said first and said third legs not being curved in the forward direction when said legs are in said first position;

c. said second leg being curved in the rearward direction when said legs are in said second position said second le not being curved in the rearward direction when said legs are in said first position, said legs when in said second position defining a free-standing tripod d. a cantilevered shelf, said cantilevered shelf comprising:

a top side;

a first cantilevered shelf end;

a first bearing surface located at said first cantilevered shelf end, each of said first and said second legs defining a leg front side and a leg back side, said first bearing surface being configured to engage said leg front side of said first or said third legs;

a second bearing surface located at said first cantilevered shelf end, said second bearing surface being configured to engage said leg back side of said first or said third legs, said first and said second bearing surfaces being in a vertically spaced-apart relation with said second bearing surface being above said first bearing surface when said cantilevered shelf is supported by said leg.

13. The easel apparatus of claim 12, the apparatus further comprising: a spacer, said spacer being disposed between said second leg and said first and third legs when said legs are in said second position, said spacer having a front side and a back side, said first and said third legs resiliently pressing against said front side of said spacer and said second leg resiliently pressing against said back side of said spacer when said legs are in said second position.

14. The apparatus of claim 12 wherein said first and said second bearing surfaces have a separation distance, said separation distance defining said vertically spaced-apart relation of said first and second bearing surfaces, said separation distance being selected so that said cantilevered shelf is retained in a pre-determined position on said first or said third leg under a weight of said cantilevered shelf when said first and said second bearing surfaces engage said leg, said cantilevered shelf defining a lateral angle with respect to said first or said third leg when said cantilevered shelf is supported by said first or said third leg, the apparatus having an easel front side, said lateral angle being selected to avoid interference with a person located on said easel front side.

15. The apparatus of claim 14 wherein said first or said second bearing surfaces defines a cantilevered shelf peg, said cantilevered shelf peg being configured to engage a one of a row of supporting holes defined by said first or said third leg when said first and said second bearing surfaces are in engagement with said first or said third leg, said second bearing surface defining a cantilevered shelf hook protuberance, said cantilevered shelf hook protuberance being configured to engage an inside surface of said first or said third leg when said cantilevered shelf is in engagement with said first or said third leg.

16. The apparatus of claim 12 wherein said cantilevered shelf defines a second end opposite to said first end, said second end being configured to engage and to be supported by the other of said first and said third legs, said second end defining a second end first bearing surface and a second end second bearing surface, said second end first and second bearing surfaces being in said vertically spaced apart relation.

17. An easel apparatus for supporting an artwork, the apparatus having a forward direction and an opposing rearward direction, the apparatus comprising:

a. a first leg, a second leg and a third leg, said first, second and third legs each having a top end and a length, said top ends of said first, second and third legs being substantially fixed in the forward and rearward directions, said legs being elastically deformable in flexure in the forward or rearward directions between a first position and a second position;

b. said first and third legs each being curved in the forward direction when said legs are in said second position said first and said third legs not being curved in the forward direction when said legs are in said first position;

c. said second leg being curved in the rearward direction when said legs are in said second position said second leg not being curved in the rearward direction when said legs are in said first position, said legs when in said second position defining a free-standing tripod;

d. a palette holder, said palette holder defining a palette holder body, said palette holder body defining a slot, said slot being configured for releasable engagement with said first leg or said third leg said slot defining opposing first and second slot surfaces, said first and said second slot surfaces being configured for selectable engagement with said first or said third leg wherein said opposing first and second slot surfaces define a slot separation distance, said slot separation distance being selected to selectably clamp said palette holder body to said first or said third leg under a weight of said palette holder, the palette holder further comprising: a palette holder peg, said palette holder peg being defined by a one of said first and said second slot surfaces, said palette holder peg being configured to engage a mating hole in said first or said third legs when palette holder is in engagement with said first or said third leg, said first or said second slot surfaces defining a palette holder hook protuberance, said palette holder hook protuberance being configured to engage an inside surface of said first or said third legs when said palette holder is in engagement with said first or said third legs.

* * * * *